US005101471A

United States Patent [19]

Bill

[11] Patent Number: 5,101,471

[45] Date of Patent: Mar. 31, 1992

[54] WATER HEATER CONTROL SYSTEM UTILIZING FLEXIBLE THERMOSTAT COVER PLATE

[76] Inventor: Donald F. Bill, 1717 Franklin St., Berkeley, Calif. 94701

[21] Appl. No.: 719,378

[22] Filed: Jun. 24, 1991

[51] Int. Cl.[5] ..... H05B 1/02; F24H 9/20

[52] U.S. Cl. ..... 392/449; 74/18; 74/553; 74/608; 126/374

[58] Field of Search ..... 392/449–457; 126/361, 374, 344; 122/13.1, 13.2, 494; 174/5 R, 66; 74/18, 553, 608; 374/208, 209; 116/216, 221, 291, 305

[56] References Cited

U.S. PATENT DOCUMENTS

| | | | |
|---|---|---|---|
| 2,547,630 | 4/1951 | Evans | 74/18 |
| 2,587,668 | 3/1952 | Veevers et al. | 116/291 |
| 2,699,070 | 1/1955 | Cottle | 74/18 |
| 2,699,479 | 1/1955 | Gorham | 74/553 |
| 2,931,226 | 4/1960 | Sadow | 116/221 |
| 3,621,197 | 11/1971 | Place | 392/449 |
| 3,626,151 | 12/1971 | Them et al. | 392/449 |

FOREIGN PATENT DOCUMENTS

| | | | |
|---|---|---|---|
| 1067132 | 6/1954 | France | 74/553 |
| 2573271 | 5/1986 | France | 392/449 |

*Primary Examiner*—Bruce A. Reynolds
*Assistant Examiner*—John A. Jeffery
*Attorney, Agent, or Firm*—Thomas R. Lampe

[57] ABSTRACT

A system including apparatus and method for retrofitting and controlling the temperature of a water heater. The system allows manual adjustment of a thermostat control setscrew from a location exterior of the water heater housing and includes a tool maintained in engagement with the setscrew by a flexible cover plate within which the tool is rotatably mounted and which continually urges the tool toward the setscrew.

14 Claims, 3 Drawing Sheets

WATER HEATER CONTROL SYSTEM UTILIZING FLEXIBLE THERMOSTAT COVER PLATE

TECHNICAL FIELD

This invention relates to apparatus for adjusting the thermostat of a water heater. More particularly, the apparatus can be employed to retrofit existing water heaters or in connection with heaters during initial manufacture to permit adjustment of the heater thermostat from a location external of the heater housing accommodating the thermostat. The system additionally includes the method employed to retrofit a heater.

BACKGROUND ART

Virtually all domestic electric water heaters incorporate thermostats and such components conventionally are located immediately adjacent to the heater tank and within the interior of the heater housing.

While electric water heater thermostats are adjustable, typically by means of a rotatable setscrew, the adjustment operation is an awkward and time-consuming process because access to the setscrew is difficult and inconvenient. For one thing, a person wishing to adjust the thermostat must first remove at least one cover plate or door affixed to the outer casing or housing to obtain access to the interior of the housing. Tools usually must be employed to accomplish this step and they are not always readily available. Then too, after the cover plate is removed, it is usually necessary for an individual to dig through the insulation between the housing and the tank to locate the adjustable setscrew of the thermostat. Not only can the insulation cause irritation to the skin, great care must be taken to avoid contact with live wiring or terminals employed in the water heater. Inadvertent contact can cause physical injury and even death.

Reversing the process just described is just as inconvenient. Cover plates might not be replaced, severely degrading the insulation properties of the heater, wasting energy, and creating an electrical hazard.

Most electric heater thermostats are factory set at a predetermined temperature, most commonly in the order of 140 degrees Fahrenheit. Because of the aforedescribed difficulties encountered when attempting to change the thermostat setting, most electrical water heaters simply remain at this preset temperature, resulting in the consumption in toto of countless megawatt hours of electricity. Heat from the electric water heaters simply dissipates to the atmosphere, even when the premises is not occupied. Also, of course, one may find that the preset temperature results in water hotter than desired and the complexities of adjusting the thermostat deter a downward temperature adjustment, again resulting in a waste of energy.

DISCLOSURE OF INVENTION

The apparatus of the present invention allows the user to readily and quickly adjust the control element of a water heater thermostat from a location external of the housing. The apparatus may readily be employed to retrofit existing water heaters having no external thermostat control. It also may be installed during the manufacture of electric water heaters Water heaters are the most energy intensive appliances in the home today. Employment of the apparatus of the present invention on a wide-spread scale will result in tremendous energy savings.

The apparatus is for employment with a water heater having a housing defining an interior accommodating a thermostat and an opening communicating with the interior.

The thermostat includes an adjustable control element disposed within the housing interior and directed outwardly toward the opening.

The apparatus includes a flexible plate covering the opening and defining an aperture communicating with the opening. Attachment means attaches the flexible plate to the housing with the aperture spaced from the control element.

Tool means of a specified character projects through the aperture, the tool means being in frictional engagement with the plate and rotatably mounted relative thereto. The flexible plate exerts a biasing force on the tool in the direction of the control element to urge the tool means toward the control element.

The tool means includes a shaft, a tool element at an end of the shaft disposed within the housing interior and a manually graspable element at an end of the shaft disposed externally of the housing interior and outwardly of the flexible plate to facilitate movement of the tool means relative to the plate.

A washer is affixed to the flexible plate, the washer defining a hole in communication with the aperture and with the opening and reinforcing the flexible plate in the area of the aperture. The flexible plate is constructed of transparent, plastic sheet material. This feature enables the operator to observe the calibrations on the thermostat body and the relative positioning of the tool and thermostat setscrew. The transparency feature also allows for the possible use of a small indicator lamp, in operative association with the heating element within the housing, to provide an indication of when the heater is using electricity. The flexible plastic plate, being of dielectric material lessens the possibility of electric shock, as compared with conventional metal cover plates.

As indicated above, the present invention also encompasses a method of retrofitting a water heater. The method includes the step of removing the conventional metal cover plate from the housing to expose the opening. A flexible plate is positioned over the opening and then secured to the housing.

A tool is positioned in an aperture formed in the flexible plate whereby the tool projects into the housing interior and is positioned in general alignment with the control element.

The tool is manipulated to move the tool relative to the control element, flexing of the flexible plate outwardly away from the control element occurring during this step. The flexed flexible plate exerts a biasing force on the tool to urge the tool toward the control element. The next step is to move the control element with the tool after bringing the tool into engagement with the control element.

Other features, advantages, and objects of the present invention will become apparent with reference to the following description and accompanying drawings.

BEST MODE FOR CARRYING OUT THE INVENTION

Figure 1:
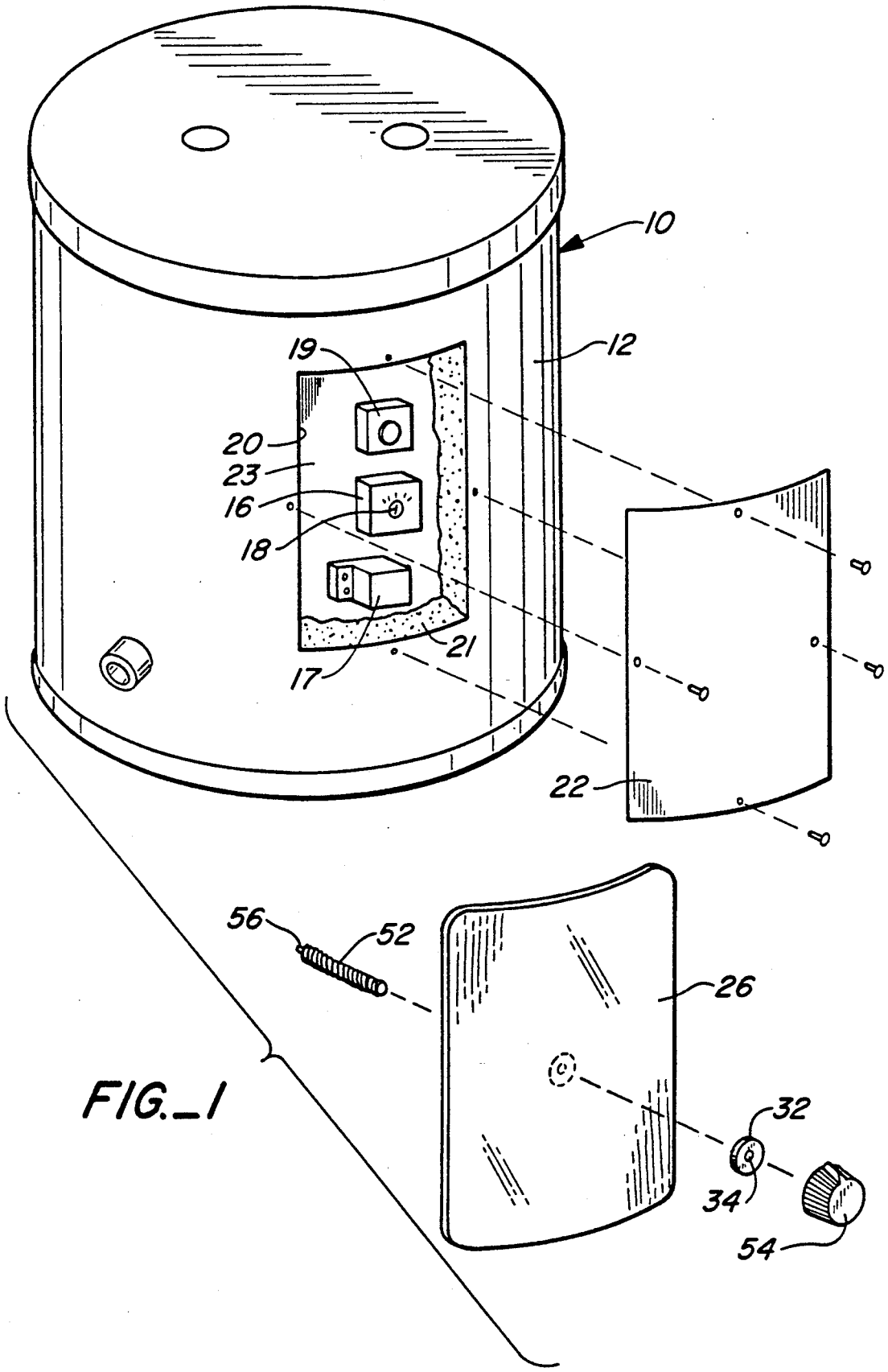
FIG. 1 is a exploded, perspective view illustrating a water heater with its original cover plate removed and components of the present invention positioned prior to installation.

Referring now to the drawings, a conventional electric water heater is designated by reference numeral 10. The water heater includes a housing 12 defining an interior 14 accommodating a thermostat 16, a heater element 17, and a reset 19. The thermostat, of course, is utilized to control the temperature of the water in the heater tank and includes an adjustable control element in the form of a setscrew 18.

As is conventional, an opening 20 is formed in the housing in the vicinity of the thermostat. A cover plate or door 22, usually of metal construction, is secured to the housing and covers opening 20. Fasteners such as screws are employed for this purpose. FIG. 1 shows plate 22 removed from the housing. Insulation, such as fiberglass insulation 21, is located within the housing and about the tank 23.

Figure 2:
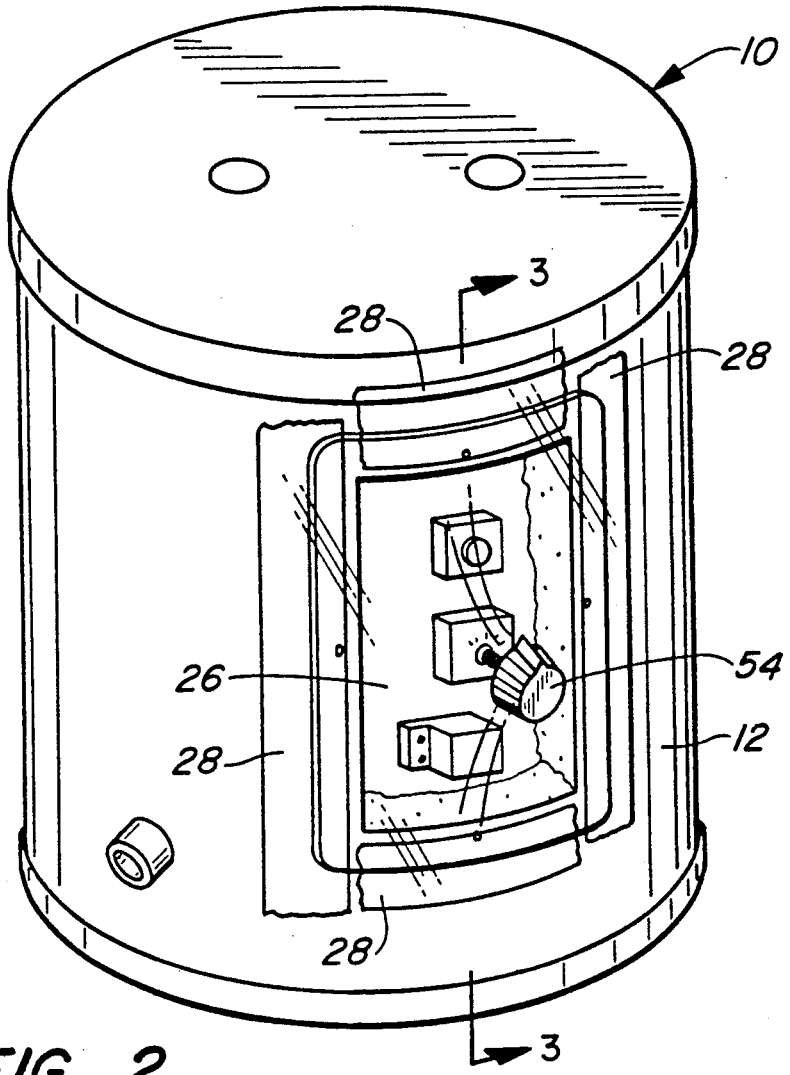
FIG. 2 illustrates apparatus of the present invention in position on a water heater.
Figure 4:
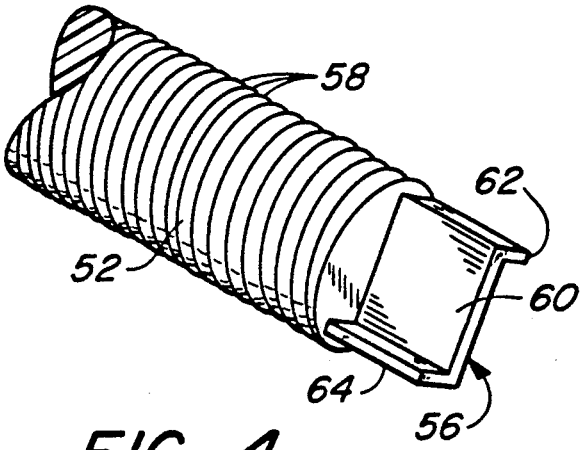
FIG. 4 is an enlarged, perspective view illustrating details of a portion of a tool employed in the apparatus according to the present invention.
Figure 5:
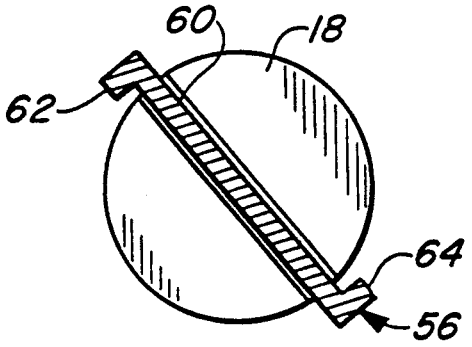
FIG. 5 is an enlarged, diagrammatic view illustrating positioning of the tool relative to the heater thermostat setscrew.

The first step in practicing the method of the present invention is to remove the cover plate 22 from the heater housing as by means of a screwdriver. Removal of the cover plate provides access to the interior of the housing and the thermostat 16 disposed therein According to the next step of the method, a sheet 26 of transparent plastic material is positioned over opening 20. A suitable sheet material is flame-resistant, plasticized heavy vinyl film or other clear polymer sufficiently thin that it may be flexed upon application of an external force thereto. The sheet is of a size that it completely covers opening 20 and overlays the border of the housing immediately surrounding and defining opening 20 as shown in FIG. 2. If necessary, the sheet may be trimmed to size.

Next, the sheet or flexible plate 26 is attached to the housing. One suitable means for accomplishing this is adhesive tape 28. Such an expedient will form a tight air seal between the flexible plate 26 and the housing and actually improve the insulating efficiency of the heater as compared to the original metal cover plate which often defines gaps with the housing.

The next step in the method of the present invention is to attach a washer 32 to the flexible plate 26. Washer 32 is preferably formed of a plastic material and defines a hole 34. A suitable adhesive may be utilized to secure the washer to the flexible plate. The positioning of the washer is important. More particularly, the washer 32 should be positioned on the flexible plate 26 so that hole 34 is more or less aligned with the setscrew 18 of thermostat 16. Of course, the person installing the washer can see the location of the setscrew through the flexible plate since this latter element is of transparent material.

Figure 6:
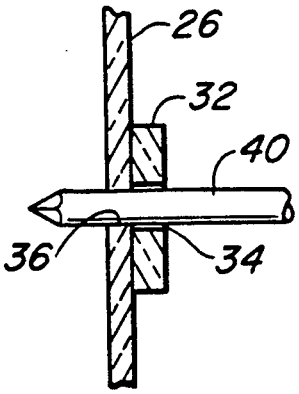
FIG. 6 is a partial, sectional view illustrating formation of an aperture in the flexible plate of the invention.

Now the installer forms an aperture 36 in the flexible plate 26 in alignment with the hole 34 of washer 32. One suitable expedient for accomplishing this is to heat a piercing rod or pin 40 and insert the heated rod through hole 34 as shown in FIG. 6. Assuming the rod 40 is heated sufficiently, it will melt the flexible plate 26 and form an aperture in alignment with the hole 34.

The next component of the apparatus of the present invention to be placed in position by carrying out the steps of the invention method is a tool 50. Tool 50 includes a threaded shaft 52, formed of any suitable material such as nylon, having a knob 54 attached thereto at one end thereof and a tool element 56 located at the other end thereof. The precise nature of the tool element and its function will be described in greater detail below.

Figure 3:
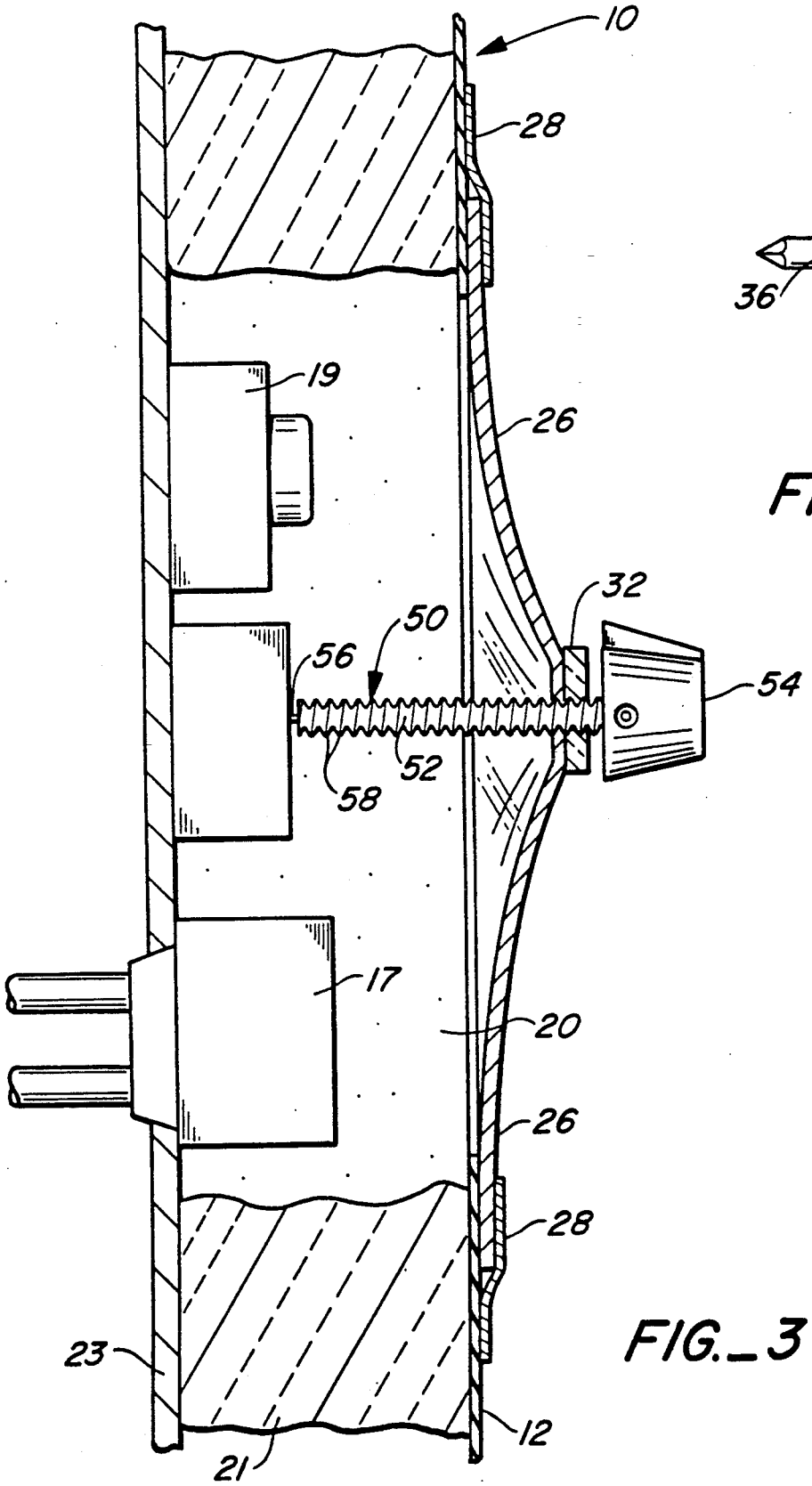
FIG. 3 is an enlarged, cross-sectional view taken along the line 3—3 of FIG. 2.

The tool element 56 and shaft 52 of tool 50 are inserted into hole 34 of washer 32 and thence into aperture 36 of plate 26. The outer periphery of the shaft is in tight engagement with the washer and flexible plate 26. The shaft 52 of the tool has threads 58 formed thereon. By rotating the tool, the threads will cooperate with the washer and flexible plate to cause penetration of the shaft into the interior 14 of housing 12. The installer stops twisting just before the tool element 56 engages the setscrew 18 of the thermostat. Then the installer pulls outwardly on the tool. This will cause flexible plate 26 to flex outwardly as shown in exaggerated fashion in FIG. 3. The tool is then threaded another turn or two. When the installer releases the tool the tool will engage the setscrew under the urging of flexed flexible plate 26 which biases the tool toward and into engagement with the setscrew 18. Some degree of flex will remain in the flexible plate and this will maintain engagement between the tool and setscrew It will be appreciated that the tool may not be in precise alignment with the setscrew 18. This presents no problem since the washer 32 can function as a fulcrum, enabling the operator to pivot the tool as appropriate to ensure alignment and engagement between the setscrew and the tool element. After such engagement has taken place, the operator twists the knob 54 slightly to rotate the setscrew to the desired adjusted position The tool element 56 has a unique configuration which facilitates use of the tool. More particularly, tool element 56 includes a flat plate-like primary member 60 and a pair of end members 62, 64 projecting at some angle thereto at opposite ends of the primary member. Such an arrangement maintains the tool element in engagement with the setscrew and properly positioned relative thereto once the primary member 60 is positioned in the setscrew slot. Heater setscrews come in different sizes and the tool element shape just disclosed readily accommodates itself to use with them all.

I claim:

1. Apparatus for adjusting the thermostat of a water heater, said water heater having a housing defining an interior accommodating said thermostat and an opening communicating with said interior, said thermostat including an adjustable control element disposed within said interior and directed outwardly toward said opening, said apparatus comprising, in combination:

a flexible plate covering said opening and defining an aperture communicating with said opening;

attachment means attaching said flexible plate to said housing with said aperture spaced from said control element; and tool means projecting through said aperture, said tool means being in frictional engagement with said plate and rotatable relative to said plate, and said flexible plate exerting a biasing force on said tool in the direction of said control element to urge said tool means toward said control element.

2. The apparatus according to claim 1 wherein said control element is a thermostat adjustable setscrew 3. The apparatus according to claim 1 wherein said tool means has an inner distal end and an outer distal end, said tool means being pivotally mounted on said flexible plate at a location on said tool means between said inner and outer distal ends whereby said flexible plate operates as a fulcrum for said tool means.

4. The apparatus according to claim 1 wherein said tool means includes a shaft, a tool element at an end of said shaft disposed within said housing interior, and a manually graspable element at an end of said shaft disposed externally of said housing interior and outwardly of said flexible plate to facilitate movement of said tool means relative to said plate.

5. The apparatus according to claim 4 additionally comprising a washer affixed to said flexible plate, said washer defining a hole in communication with said aperture and with said opening and reinforcing said flexible plate in the area of said aperture.

6. The apparatus according to claim 1 wherein said flexible plate is constructed of transparent, plastic sheet material.

7. The apparatus according to claim 1 wherein said attachment means comprises adhesive tape securing said flexible plate to said housing.

8. The apparatus according to claim 1 wherein said tool means includes a shaft and a tool element mounted at a distal end of said shaft, said tool element comprising a flat, plate-like primary member and a pair of end members integral with said primary member and projecting at angles thereto from opposite ends of said primary member.

9. A method of retrofitting and controlling the temperature of a water heater having a housing defining an interior, an opening communicating with said interior, a thermostat having a control element disposed within said interior and directed outwardly toward said opening, and a cover plate connected to said housing covering said interior, to allow manual adjustment of said control element from a location exterior of said housing, said method comprising the steps of:

removing said cover plate from said housing to expose the opening;

positioning a flexible plate over said opening;

securing the flexible plate to said housing after positioning the flexible plate over said opening;

positioning a tool in an aperture formed in said flexible plate whereby said tool projects into the housing interior and is positioned in general alignment with said control element;

manipulating said tool to move said tool relative to said control element;

flexing said flexible plate outwardly away from said control element during said step of manipulating said tool;

urging said tool toward said control element by exerting a biasing force on said tool by said flexed flexible plate; and moving said control element with said tool after bringing said tool into engagement with said control element 10. The method according to claim 9 additionally including the step of forming said aperture in said flexible plate after the step of positioning said flexible plate over said housing opening.

11. The method according to claim 9 including the step of reinforcing said flexible plate in the area of said flexible plate surrounding said aperture.

12. The method according to claim 11 wherein said reinforcing step is carried out by affixing a washer to said flexible plate.

13. The method according to claim 9 wherein said flexible plate is formed of flexible, transparent plastic material.

14. The method according to claim 9 wherein said manipulating step includes rotating said tool in said flexible plate while maintaining said tool in engagement with said control element.

* * * * *